US010135114B2

(12) United States Patent
Niwano et al.

(10) Patent No.: US 10,135,114 B2
(45) Date of Patent: Nov. 20, 2018

(54) MIMO ANTENNA AND MIMO ANTENNA ARRANGEMENT STRUCTURE

(71) Applicant: AGC INC., Tokyo (JP)

(72) Inventors: Kazuhiko Niwano, Tokyo (JP); Kouichirou Takahashi, Tokyo (JP); Koji Ikawa, Tokyo (JP)

(73) Assignee: AGC Inc., Tokyo (JP)

( * ) Notice: Subject to any disclaimer, the term of this patent is extended or adjusted under 35 U.S.C. 154(b) by 39 days.

(21) Appl. No.: 15/001,629

(22) Filed: Jan. 20, 2016

(65) Prior Publication Data

US 2016/0226127 A1 Aug. 4, 2016

(30) Foreign Application Priority Data

Jan. 30, 2015 (JP) ..... 2015-016748

(51) Int. Cl.
*H01Q 1/12* (2006.01)
*H01Q 21/28* (2006.01)

(52) U.S. Cl.
CPC ..... *H01Q 1/1271* (2013.01); *H01Q 21/28* (2013.01)

(58) Field of Classification Search
CPC ..... H01Q 1/1271; H01Q 21/28
See application file for complete search history.

(56) References Cited

U.S. PATENT DOCUMENTS 5,757,328 A * 5/1998 Saitoh ..... H01Q 1/1271 343/713
5,825,096 A * 10/1998 Morimoto ..... B60R 11/02 180/90
2004/0119644 A1* 6/2004 Puente-Baliarda ..... H01Q 1/1271 343/700 MS
2007/0120756 A1* 5/2007 Ogino ..... H01Q 1/1271 343/713
2010/0231466 A1* 9/2010 Hisaeda ..... H01Q 1/1271 343/713

(Continued)

FOREIGN PATENT DOCUMENTS

EP 2 960 986 A1 12/2015
JP 2006-115300 4/2006

(Continued)

OTHER PUBLICATIONS

Karasawa, "MIMO Propagation Channel Modeling," IEICE Transactions on Communications B, vol. J86-B, No. 9, pp. 1706-1720 (Sep. 2003).

(Continued)

*Primary Examiner* — Daniel J Munoz
(74) *Attorney, Agent, or Firm* — Foley & Lardner LLP

(57) ABSTRACT

A MIMO antenna includes a plurality of antenna elements respectively including a plurality of conductive elements that are connected to different feeding points from each other; and one or more base members each being directly or indirectly provided at an upper edge portion of a windshield of a vehicle, the conductive elements being provided at either of the base members, wherein D/W, where "W" is a width of an open portion of a window frame at which the windshield is provided and "D" is a minimum distance between the conductive elements of the antenna elements in a direction parallel to the direction of "W", is less than or equal to 0.35.

20 Claims, 7 Drawing Sheets

(56) References Cited

U.S. PATENT DOCUMENTS

| | | | | |
|---|---|---|---|---|
| 2010/0231468 | A1* | 9/2010 | Ogino | H01Q 1/1271 343/713 |
| 2010/0289710 | A1* | 11/2010 | Ogino | H04L 12/4633 343/713 |
| 2015/0303577 | A1 | 10/2015 | Sonoda et al. | |
| 2015/0357700 | A1 | 12/2015 | Kagaya et al. | |

FOREIGN PATENT DOCUMENTS

| | | | |
|---|---|---|---|
| JP | 2008-148305 | | 6/2008 |
| JP | 2010-068473 | A | 3/2010 |
| JP | 2010-200160 | | 9/2010 |
| WO | WO-2006/061218 | A1 | 6/2006 |
| WO | WO-2014/109397 | A1 | 7/2014 |
| WO | WO-2014/129588 | A1 | 8/2014 |

OTHER PUBLICATIONS

Taga, "Analysis for Correlation Characteristics of Antenna Diversity in Land Mobile Radio Environments," IEICE Transactions on Communications B-II, vol. J73-B-II, No. 12, pp. 883-895 (Dec. 1990).

Japanese Office Action dated Aug. 7 ,2018 in corresponding application No. 2015-016748.

* cited by examiner

| | | SNR | | | | | | |
|---|---|---|---|---|---|---|---|---|
| | | 0 | 5 | 10 | 15 | 20 | 25 | 30 |
| D/W | 0.08 | 0.00 | 0.00 | 0.01 | 0.01 | 0.01 | 0.01 | 0.01 |
| | 0.15 | 0.01 | 0.01 | 0.02 | 0.01 | 0.02 | 0.02 | 0.02 |
| | 0.23 | 0.02 | 0.02 | 0.03 | 0.04 | 0.05 | 0.04 | 0.05 |
| | 0.31 | 0.03 | 0.05 | 0.07 | 0.09 | 0.10 | 0.11 | 0.12 |
| | 0.38 | 0.04 | 0.07 | 0.11 | 0.14 | 0.16 | 0.18 | 0.18 |
| | 0.46 | 0.05 | 0.10 | 0.17 | 0.21 | 0.24 | 0.26 | 0.27 |
| | 0.54 | 0.07 | 0.12 | 0.18 | 0.23 | 0.27 | 0.29 | 0.30 |
| | 0.62 | 0.06 | 0.11 | 0.17 | 0.21 | 0.26 | 0.28 | 0.28 |
| | 0.69 | 0.03 | 0.07 | 0.11 | 0.14 | 0.17 | 0.18 | 0.20 |
| | 0.77 | 0.09 | 0.16 | 0.22 | 0.29 | 0.33 | 0.35 | 0.36 |
| | 0.85 | 0.09 | 0.18 | 0.27 | 0.34 | 0.39 | 0.43 | 0.45 |

MIMO ANTENNA AND MIMO ANTENNA ARRANGEMENT STRUCTURE

CROSS-REFERENCE TO RELATED APPLICATION

The present application is based on and claims the benefit of priority of Japanese Priority Application No. 2015-016748 filed on Jan. 30, 2015, the entire contents of which are hereby incorporated by reference.

BACKGROUND OF THE INVENTION

1. Field of the Invention

The present invention relates to a MIMO antenna and a MIMO antenna arrangement structure adaptable for MIMO (Multiple Input Multiple Output).

2. Description of the Related Art

As an antenna mounted on a vehicle, an antenna is known that is provided at an upper edge portion of a windshield of the vehicle (see Patent Document 1, for example). Patent Document 1 discloses that such an antenna is adaptable for a communication method of MIMO.

However, usually, a sun visor is provided near the upper edge portion of the windshield. Thus, there is a possibility that channel capacity of the MIMO antenna that is placed near the upper edge portion is deteriorated when the sun visor moves to overlap the upper edge portion of the windshield.

Patent Document

[Patent Document 1] Japanese Laid-open Patent Publication No. 2010-68473

Non-Patent Documents

[Non-Patent Document 1] Taga, "Analysis for Correlation Characteristics of Antenna Diversity in Land Mobile Radio Environments", IEICE Transactions on Communications B-II, Vol. J-73-B-II, No. 12, p. 883-895

[Non-Patent Document 2] Karasawa, "MIMO Propagation Channel Modeling", IEICE Transactions on Communications B, Vol. J-86-B, No. 9, p. 1706-1720

SUMMARY OF THE INVENTION

The present invention is made in light of the above problems, and provides a MIMO antenna and a MIMO antenna arrangement structure capable of suppressing deterioration of channel capacity due to influence of a sun visor.

According to an embodiment, there is provided a MIMO antenna including a plurality of antenna elements respectively including a plurality of conductive elements that are connected to different feeding points from each other; and one or more base members each being directly or indirectly provided at an upper edge portion of a windshield of a vehicle, the conductive elements being provided at either of the base members, wherein D/W, where "W" is a width of an open portion of a window frame at which the windshield is provided and "D" is a minimum distance between the conductive elements of the antenna elements in a direction parallel to the direction of "W", is less than or equal to 0.35.

BRIEF DESCRIPTION OF THE DRAWINGS

Other objects, features and advantages of the present invention will become more apparent from the following detailed description when read in conjunction with the accompanying drawings.

DETAILED DESCRIPTION OF THE PREFERRED EMBODIMENTS

Figure 1:
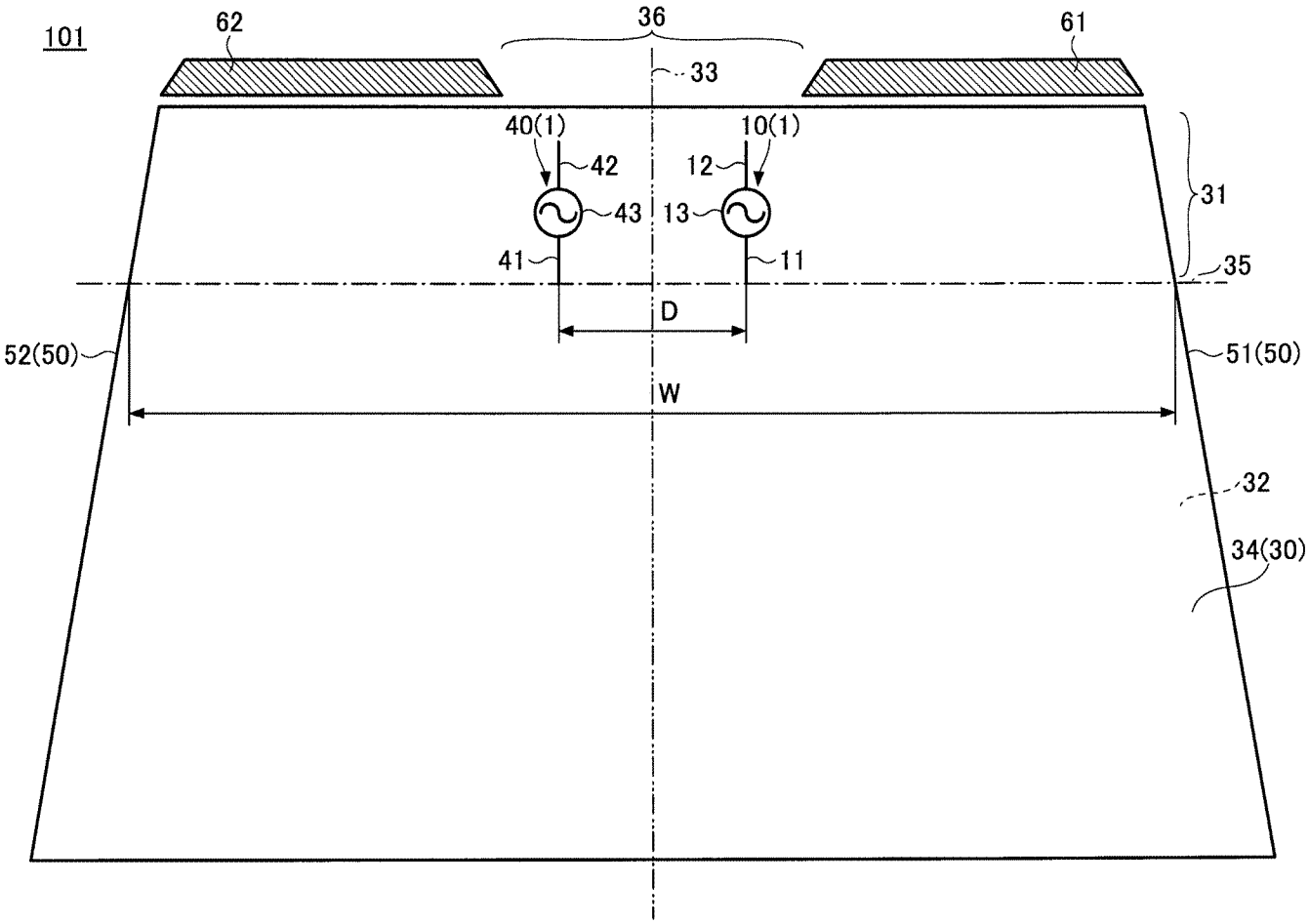
FIG. 1 is a view illustrating an example of a MIMO antenna arrangement structure in which sun visors are not overlapping a windshield.

The invention will be described herein with reference to illustrative embodiments. Those skilled in the art will recognize that many alternative embodiments can be accomplished using the teachings of the present invention and that the invention is not limited to the embodiments illustrated for explanatory purposes.

It is to be noted that, in the explanation of the drawings, the same components are given the same reference numerals, and explanations are not repeated.

Figure 2:
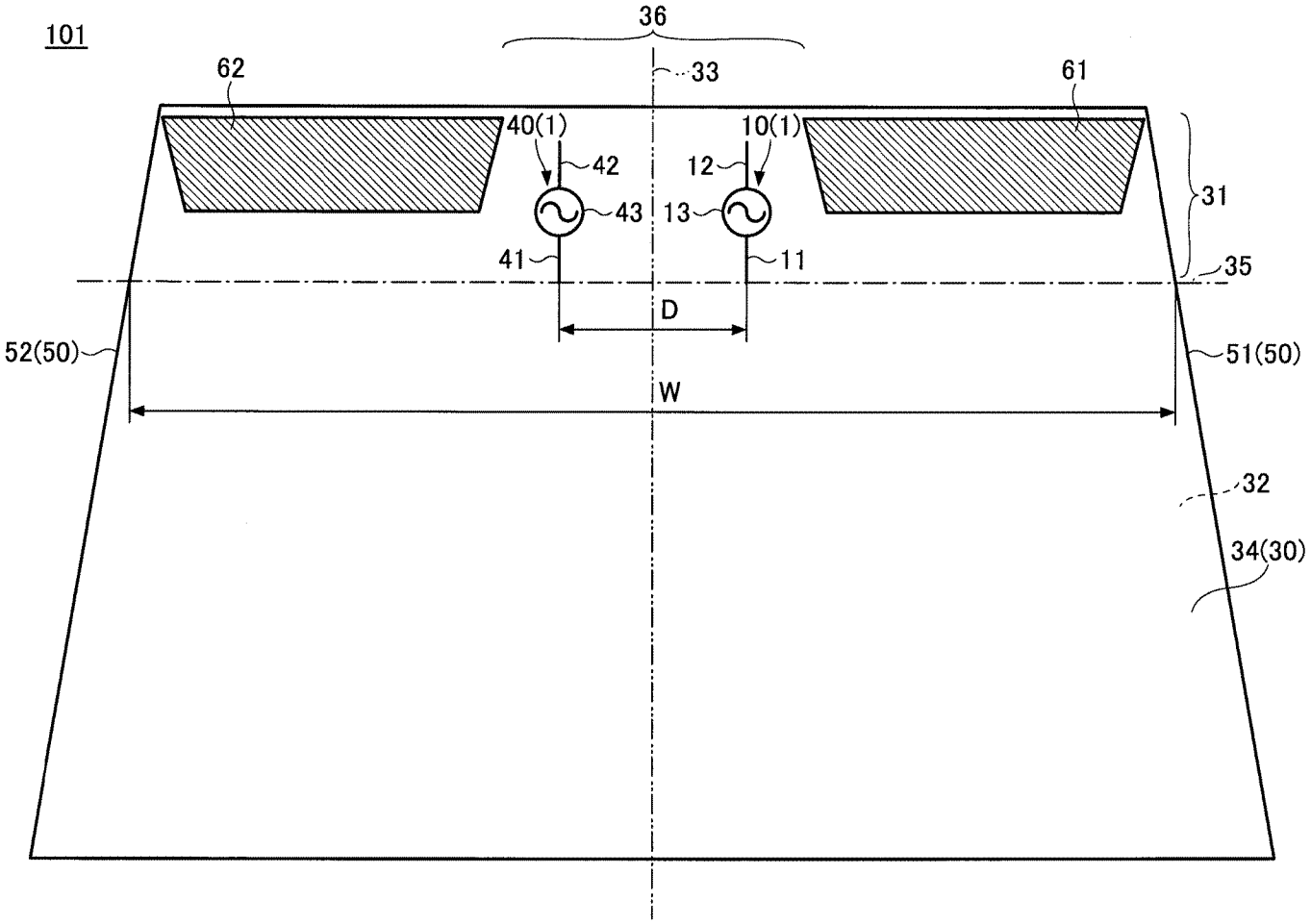
FIG. 2 is a view illustrating an example of the MIMO antenna arrangement structure in which the sun visors are overlapping the windshield.

FIG. 1 is a view schematically illustrating an example of a MIMO antenna arrangement structure 101 (hereinafter, referred to as a "arrangement structure 101") in which sun visors 61 and 62 are not overlapping an upper edge portion 31 of a windshield 30 of a vehicle. FIG. 2 is a view schematically illustrating an example of the arrangement structure 101 in which the sun visors 61 and 62 are overlapping the upper edge portion 31. FIG. 1 and FIG. 2 illustrate the windshield 30 viewed from a vehicle room side of (inside) the vehicle. A left and right direction (lateral direction) in the drawing almost corresponds to a vehicle width direction of the vehicle, and an upper and lower direction (vertical direction) in the drawing almost corresponds to an upper and lower direction of the vehicle.

The arrangement structure 101 is an example of a structure in which a MIMO antenna 1 is arranged. The arrangement structure 101 includes the windshield 30, the sun visors 61 and 62 and the MIMO antenna 1, for example.

The windshield 30 is an example of a window glass that is provided in a front of front seats of a vehicle. The windshield 30 is provided at an open portion 32 that is positioned in front of the front seats of the vehicle. The open portion 32 is provided in a window frame 50 made of metal. The windshield 30 is attached to the open portion 32 so as to seal the window frame 50. The window frame 50 includes a pair of pillars 51 and 52 that are opposed to each other in a vehicle width direction. The pillar 51 is a right pillar at which a right side frame end of the window frame 50 is formed and the pillar 52 is a left pillar at which a left side frame end of the window frame 50 is formed.

The windshield 30 includes the upper edge portion 31 at which a base member 20, which will be explained later (see FIG. 3 or the like), is directly or indirectly provided. The upper edge portion 31 is an upper side region of a glass surface 34 of the windshield 30 including the MIMO antenna 1 in an upper and lower direction. The glass surface 34 is an inner surface of the windshield 30 at the vehicle room side.

Each of the sun visors 61 and 62 is a sunshade that is provided near the upper edge portion 31, and is a plate member provided at a ceiling portion of the vehicle room above the upper edge portion 31, for example. The sun visor 61 is a right visor provided at an upper right side of the upper edge portion 31 so as to cover at least a part of a right side of the upper edge portion 31 with respect to a center line 33. The sun visor 62 is a left visor provided at an upper left side of the upper edge portion 31 so as to cover at least a part of a left side of the upper edge portion 31 with respect to the center line 33. The center line 33 expressed by a two-dot chain line is a center line of the windshield 30 extending in a vertical direction.

The MIMO antenna 1 is an example of a MIMO antenna capable of multiple-inputting and multiple-outputting at a predetermined frequency using a plurality of antenna elements respectively connected to feeding points different from each other. As long as the MIMO antenna 1 has antenna characteristics capable of reducing a correlation coefficient among a plurality of antenna elements at a resonance frequency to be less than or equal to a predetermined value, a shape of each of the plurality of antenna elements may be arbitrarily determined.

The MIMO antenna 1 includes a first antenna element 10 that is connected to a first feeding point 13 and a second antenna element 40 that is connected to a second feeding point 43, different from the first feeding point 13, for example. The MIMO antenna 1 has antenna characteristics that lowers a correlation coefficient $\rho_e$ between the first antenna element 10 and the second antenna element 40 at a resonance frequency to be less than or equal to a predetermined value (0.3, for example). The correlation coefficient $\rho_e$ may be calculated from formula (1), for example (see Non-Patent Document 1, for example).

[Formula 1]

$$\left.\begin{aligned} \rho_e \cong \frac{\left|\oint\{XPR\cdot E_{\theta 1}E^*_{\theta 2}P_\theta + E_{\phi 1}E^*_{\phi 2}P_\phi\}\cdot e^{-j\beta x}d\Omega\right|^2}{\oint(XPR\cdot E_{\theta 1}E^*_{\theta 1}P_\theta + E_{\phi 1}E^*_{\phi 1}P_\phi)d\Omega\cdot \oint(XPR\cdot E_{\theta 2}E^*_{\theta 2}P_\theta + E_{\phi 2}E^*_{\phi 2}P_\phi)d\Omega} \\ \oint d\Omega = \int_0^{2\pi}\int_0^{\pi}\sin\theta\, d\theta\, d\phi \end{aligned}\right\} \quad (1)$$

In formula (1), XPR (Cross-Polarization Ratio) is a ratio (cross polarization power ratio) of electric powers of vertical polarization components and horizontal polarization components of radio waves (arrival waves) that reach the antenna.

"$E_{\theta n}E^*_{\theta n}$" and "$E_{\varphi m}E^*_{\varphi n}$" are a complex electric field directivity of the antenna element (n=1, 2). "$P_\theta$" and "$P_\varphi$" express angle distributions of arrival waves, and "x" expresses a phase difference of arrival waves of the two antenna elements. "β" expresses an angle between a direction of a line binding the antenna elements and a vertical direction that is perpendicular to the horizontal surface where θ=0. "Ω" expresses coordinates (θ, φ) in a spherical coordinates system. "$E_{\theta n}E_{\theta n}$", "$E_{\varphi n}E_{\varphi n}$", "$P_\theta$" and "$P_\varphi$" are functions of "Ω".

In this embodiment, it is assumed that "$P_\theta$" is a Gauss distribution with respect to "θ", and "$P_\varphi$" is a Gauss distribution with respect to a horizontal plane angle φ.

An average of angles of each of the angle distributions "$P_\theta$" and "$P_\varphi$" of the arrival waves is referred to as a mean arrival angle. The mean arrival angle with respect to a vertical plane direction that is perpendicular to the horizontal surface is referred to as "mt", and the mean arrival angle with respect to the horizontal plane direction is referred to as "mp". The mean arrival angles express a direction, among a plurality of directions, from which a likelihood that the radio waves arrive is high.

Angles that are within a standard deviation of the angle distribution $P_\theta$, $P_\varphi$ of the arrival waves are referred to as angular spreads, and the angular spread with respect to the vertical plane direction that is perpendicular to the horizontal surface is referred to as "σt" and the angular spread with respect to the horizontal plane direction is referred to as "σp". The angular spreads express a degree of concentration of the arrival angles of the plurality of radio waves to be closer to the respective mean arrival angle.

It is assumed that the correlation coefficient of the embodiment is a mean correlation coefficient obtained by arbitrarily changing an angle of an arrival wave, calculating a correlation coefficient of each of the mean arrival angles and calculating an average of them. The correlation coefficient expresses a correlative scale between the antenna elements.

The MIMO antenna 1 includes a plurality of antenna elements respectively including conductive elements connected to different feeding points from each other. The first antenna element 10 of the embodiment includes the first feeding point 13, a first conductive element 11 connected to the first feeding point 13 and a second conductive element 12 connected to the first feeding point 13. The second antenna element 40 of the embodiment includes the second feeding point 43, that is different from the first feeding point 13, a first conductive element 41 connected to the second feeding point 43 and a second conductive element 42 connected to the second feeding point 43.

The first conductive element 11 and the second conductive element 12 are provided at a base member that is directly or indirectly provided at the upper edge portion 31. The first conductive element 41 and the second conductive element 42 are also provided at a base member that is directly or indirectly provided at the upper edge portion 31.

Figure 3:
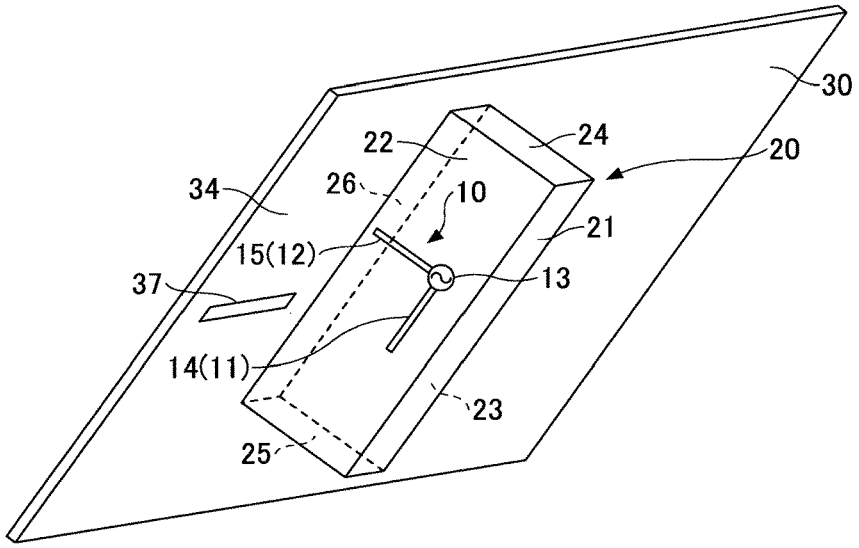
FIG. 3 is a perspective view illustrating an example of a base member.

FIG. 3 is a perspective view schematically illustrating an example of the base member 20 that is directly or indirectly provided at the upper edge portion 31 of the windshield 30. FIG. 3 partially illustrates the upper edge portion 31 at which the base member 20 is provided. "The base member 20 is directly provided at the upper edge portion 31" means that the base member 20 is provided under a state that the base member 20 physically contacts the upper edge portion 31. On the other hand, "the base member 20 is indirectly provided at the upper edge portion 31" means that the base member 20 is provided at the upper edge portion 31 via an intermediate member and the base member 20 does not physically contact the upper edge portion 31. For example, the base member 20 may be indirectly provided at the upper edge portion 31 by being provided at an intermediate member, that is provided at the upper edge portion 31 in a physically contacted manner, in a physically contacted manner.

It is preferable that the base member 20 is composed of an insulating material (resin, for example) such as a dielectric material, however, as long as the MIMO antenna 1 can be operated as a MIMO antenna, the base member 20 may be composed of another arbitrary material. Further, as long as the MIMO antenna 1 can be operated as a MIMO antenna, the shape of the base member 20 may be arbitrarily determined.

FIG. 3 illustrates an example of the base member 20 at which the first conductive element 11 and the second conductive element 12 of the first antenna element 10 are provided. The first conductive element 41 and the second conductive element 42 of the second antenna element 40 (see FIG. 1 and FIG. 2) are provided at the base member 20 similarly as the first conductive element 11 and the second conductive element 12. The first conductive element 41 and the second conductive element 42 are not illustrated in FIG. 3. The windshield 30 is inclined with respect to a horizontal plane (the horizontal surface). The base member 20 has a rectangular solid shape, for example, and is provided with a left side portion 22, a right side portion 23, a top portion 24, a bottom portion 25, a front surface portion 21 and a back surface portion (attaching portion) 26. The first conductive element 41 and the second conductive element 42 may be provided at the base member 20 at which the first conductive element 11 and the second conductive element 12 are also provided, or another base member 20 that is different from the base member 20 at which the first conductive element 11 and the second conductive element 12 are provided.

The base member 20 may be an attaching member for attaching a rear-view mirror to the upper edge portion 31, for example. With this configuration, the base member 20 can function as an attaching member for the rear-view mirror and an attaching member for the MIMO antenna 1. The base member 20 may be an attaching member for attaching an electronic device such as a rain sensor or a camera at the upper edge portion 31.

Referring back to FIG. 1 and FIG. 2, it is assumed that a minimum distance between a conductive element (11 or 12) connected to the first feeding point 13 of the first antenna element 10 and a conductive element (41 or 42) connected to the second feeding point 43 of the second antenna element 40 is "D", and a width of the open portion 32 at which the windshield 30 is provided is "W". Here, a dashed line 35 is provided to pass through such parts of the conductive element (11 or 12) connected to the first feeding point 13 and the conductive element (41 or 42) connected to the second feeding point 43 that are positioned closest. The width W is a minimum distance between a first intersection of the dashed line 35 and the pillar 51 and a second intersection of the dashed line 35 and the pillar 52. The minimum distance "D" is a distance in a direction parallel (including substantially parallel) to the width W between parts of the conductive element (11 or 12) connected to the first feeding point 13 and the conductive element (41 or 42) connected to the second feeding point 43 that are positioned closest.

As long as the MIMO antenna 1 has antenna characteristics capable of reducing the correlation coefficient among the plurality of antenna elements at a resonance frequency to be less than or equal to a predetermined value, the shape of the conductive elements of each of the plurality of antenna elements may be arbitrarily determined. Thus, the minimum distance "D" may be specified by closest parts of the first conductive element 11 and the first conductive element 41, closest parts of the first conductive element 11 and the second conductive element 42, closest parts of the second conductive element 12 and the second conductive element 42, or closest parts of the second conductive element 12 and the first conductive element 41.

By setting D/W, which is a ratio of the minimum distance D and the width W, to be less than or equal to 0.35, influence of the pillars 51 and 52 to lower the antenna gain of the MIMO antenna 1 can be reduced compared with a case when D/W is larger than 0.35. Further, even when the sun visors 61 and 62 overlap the upper edge portion 31 to face the upper edge portion 31, lowering of the antenna gain of the MIMO antenna 1 due to the sun visors 61 and 62 can be suppressed. As a result, deterioration of channel capacity of the MIMO antenna 1 due to the sun visors 61 and 62 can be suppressed.

The channel capacity expresses a density of signals capable of being multiplexed without causing interference at a propagation channel of a certain frequency. When the channel capacity is high, communication speed is improved if different information streams are transmitted by a MIMO antenna, and a signal-noise ratio (SNR) at a receiving side is improved if the same information stream is transmitted. The channel capacity expresses a communication efficiency index among MIMO antennas.

The channel capacity C is expressed by the formula (2) when propagation environmental information at a transmitting side is known, and an optimal transmit power can be allocated (see Non-Patent Document 2, for example).

[Formula 2]

$$\left.\begin{aligned} C &= \sum_{i=1}^{M} \log_2(1+\lambda_i\gamma_i) \\ \gamma_0 &= \sum_{i=1}^{M} \gamma_i \end{aligned}\right\} \tag{2}$$

Here, "$\lambda_i$" is an "i"th eigenvalue of a propagator matrix, and "M" expresses rank of the propagator matrix. Further, generally, the channel capacity C is often normalized by characteristics of a single antenna, and "$\gamma_0$" expresses a signal-noise ratio (SNR) when information is received by a single antenna in a propagation path of eigenpath 1.

When "$\gamma_0$" is sufficiently high, sufficient multiplexing gains can be obtained when equal electric power is allocated to each eigenpath. When "$\gamma_0$" is low, it is expected that the SNR is improved by a maximal ratio combining when all of the electric power is applied to a path of the maximum eigenvalue.

Here, "$\gamma_i$" expresses a normalized signal-noise ratio (linear value) of each eigenpath. By imposing a condition that a total value of "$\gamma_i$" is the same among paths to which allocations of the electric power are different, "$\gamma_i$" can be a standard for comparing cases in which the allocations of the electric power are different. It is assumed that the normalized signal-noise ratio of each eigenpath in a MIMO spatial multiplexing mode is $\gamma_i=\gamma_0/M$ ($1 \le i \le M$).

In this embodiment, the propagator matrix is obtained by randomly generating an arrival angle of each (each wave) of a plurality of radio waves in accordance with a distribution condition (arrival angle distribution condition) of angles (arrival angles) at which the radio waves arrive and complex compositing each of the radio waves.

With reference to FIG. 3, the first conductive element 11 corresponds to a first conductive portion 14 that is apart (distanced away) from the glass surface 34 of the windshield 30, and the second conductive element 12 corresponds to a second conductive portion 15 that is apart from the glass surface 34 of the windshield 30. The first conductive element 11 may include the first conductive portion 14, and the second conductive element 12 may include the second conductive portion 15. In other words, a part of the first conductive element 11 may be the first conductive portion 14, and a part of the second conductive element 12 may be the second conductive portion 15. The first conductive portion 14 and the second conductive portion 15 are not portions that are two dimensionally provided to be in contact with the glass surface 34, but are portions provided at positions apart from the glass surface 34. Further, for the case of FIG. 3, the first conductive portion 14 is placed to be parallel (including substantially parallel) to the glass surface 34, and the second conductive portion 15 is placed to be perpendicular (including substantially perpendicular) to the glass surface 34.

By providing such conductive portions as the first conductive portion 14, the second conductive portion 15 or the like, influence of the attaching angle of the windshield 30 with respect to the horizontal plane can be reduced on the antenna gain of the first antenna element 10 by receiving the radio wave of the vertical polarization arriving from a direction parallel to the horizontal plane. This is the same for the case that the first conductive element 41 and the second conductive element 42 of the second antenna element 40 respectively include conductive portions that are apart from the glass surface 34. As a result, the antenna gains of the first antenna element 10 and the second antenna element 40 are improved and deterioration of channel capacity of the MIMO antenna 1 can be suppressed.

However, each of the first antenna element 10 and the second antenna element 40 may include a conductive portion that is two dimensionally provided to be in contact with the glass surface 34.

At least a part of the conductive portion that is apart from the glass surface 34 is provided at a region (the left side portion 22, the right side portion 23, the top portion 24, the bottom portion 25, the front surface portion 21 or inside the base member 20, for example) of the base member 20 that is apart from the glass surface 34. The attaching portion 26 of the base member 20 is not a region that is apart from the glass surface 34 but is a region that directly or indirectly contacts the glass surface 34 of the upper edge portion 31.

It is preferable that at least a part of the conductive portion that is apart from the glass surface 34 is provided to be inclined with respect to the glass surface 34 for further suppressing deterioration of the channel capacity of the MIMO antenna 1. It is more preferable that at least a part of the conductive portion that is apart from the glass surface 34 is provided to be inclined with respect to the glass surface 34 and the horizontal plane. The inclined part in this embodiment includes a status in which it is perpendicular (substantially perpendicular may be included) with respect to the glass surface 34. Thus, as the second conductive element 12 (the second conductive portion 15) is perpendicular to the glass surface 34, this means that the second conductive element 12 (the second conductive portion 15) is inclined with respect to the glass surface 34 and also to the horizontal plane. Further, similarly, the first conductive element 11 (first conductive portion 14) may be inclined with respect to the glass surface 34 and the horizontal surface.

When the first antenna element 10 and the second antenna element 40 are provided at the same base member 20, the conductive portions, each of which is apart from the glass surface 34 and is inclined with respect to the glass surface 34, may be provided at both sides of the vehicle width direction of the base member 20, for example. With this configuration, as a certain minimum distance D (see FIG. 1 and FIG. 2) can be retained, increasing of the correlation coefficient $\rho_e$ due to decreasing of the minimum distance D can be suppressed.

For example, the conductive portion of the first antenna element 10 that is apart from the glass surface 34 and also is inclined with respect to the glass surface 34 is placed at the right side portion 23 of the base member 20. Further, for example, the conductive portion of the second antenna element 40 that is apart from the glass surface 34 and is inclined with respect to the glass surface 34 is provided at the left side portion 22 of the base member 20 that is opposing the right side portion 23.

It is preferable that the conductive element connected to the first feeding point 13 of the first antenna element 10 and the conductive element connected to the second feeding point 43 of the second antenna element 40 are positioned line symmetrically with respect to the center line 33 (see FIG. 1 and FIG. 2). With this configuration, directivities of the MIMO antenna 1 around the vehicle at the right side and the left side of the vehicle can be easily equalized. In this embodiment, as illustrated in FIG. 1 and FIG. 2, the first conductive element 11 and the first conductive element 41 are line symmetrically positioned such that to be parallel (substantially parallel may be included) to the center line 33, and the second conductive element 12 and the second conductive element 42 are line symmetrically positioned such that to be parallel (substantially parallel may be included) to the center line 33. However, a structure in which a pair of conductive elements is line symmetrically positioned is not limited to the structure as illustrated in the drawings, and a pair of conductive elements may be line symmetrically positioned in a V shape or a reversed V shape, for example.

It is preferable that the base member 20 is directly or indirectly provided at the center portion 36 (see FIG. 1 and FIG. 2) of the upper edge portion 31 for further suppressing deterioration of channel capacity of the MIMO antenna 1 due to the sun visors 61 and 62 that overlap the upper edge portion 31. The range of the center portion 36 in the vehicle width direction is a range between a right side region of the upper edge portion 31 at which the sun visor 61 overlaps and a left side region of the upper edge portion 31 at which the sun visor 62 overlaps, for example.

The MIMO antenna 1 may include a passive (parasitic) element 37, that is not physically connected to the feeding point (13 or 42), provided at the windshield 30. By providing the passive element 37, directivity of the MIMO antenna 1 can be finely adjusted. The MIMO antenna 1 may include one or more passive elements 37. FIG. 3 illustrates an example in which a linear passive element 37 to which the electricity is not provided by any of the first feeding point 13 and the second feeding point 43. In FIG. 3, the passive element 37 is provided at the left side portion 22 side of the windshield 30 at which the first antenna element 10 is provided.

When the first antenna element 10 is fed by the first feeding point 13, current flows through the first conductive element 11 and the second conductive element 12. When the current flows through the first conductive element 11 and the second conductive element 12, a magnetic field is generated near the first conductive element 11 and the second conductive element 12, and an electric field surface is generated that is perpendicular to a magnetic field surface. These are the same for the second antenna element 40.

In the first antenna element 10 illustrated in FIG. 3, the first conductive element 11 is a linear or strip-shaped conductor whose one end is an open end. The second conductive element 12 is a linear or strip-shaped conductor whose one end is an open end. The first conductive element 11 and the second conductive element 12 are electrically connected to the first feeding point 13 at other ends, different from the open ends, respectively. These are the same for the second antenna element 40.

The "electrically connected" includes that the conductors directly contact and direct current flows therethrough and that the conductors are apart from each other to form a capacitor and are made electrically conductive by high frequency.

FIG. 3 illustrates an example in which each of the first conductive element 11 and the second conductive element 12 has a linear shape. However, alternatively, the first conductive element 11 and the second conductive element 12 may have a wound shape such as a meandering shape, or may have a branched point. Further, the first antenna element 10 may have a shape (U-shape or the like, for example) in which the second conductive element 12 is turned toward an open end side of the first conductive element 11. These are the same for the second antenna element 40.

Figure 4A:
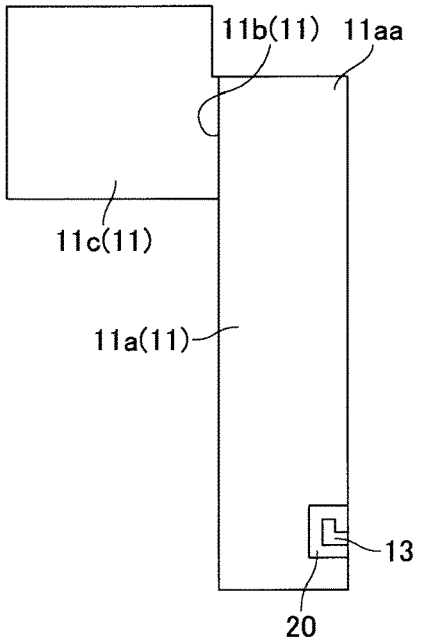
FIG. 4A is a front view illustrating an example of an antenna element including a conductive element provided at the base member.
Figure 4B:
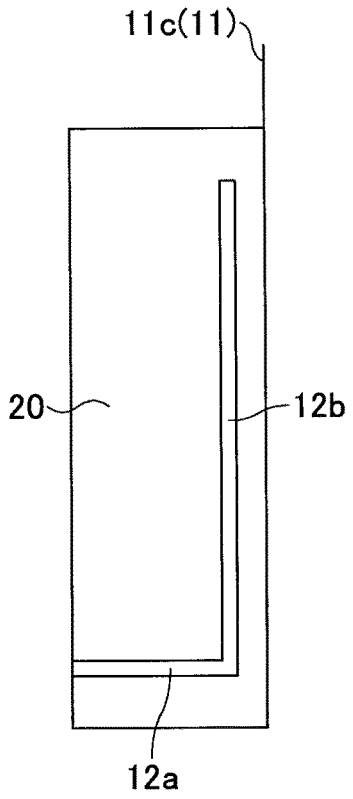
FIG. 4B is a right side view illustrating an example of the antenna element including the conductive element provided at the base member.
Figure 4C:
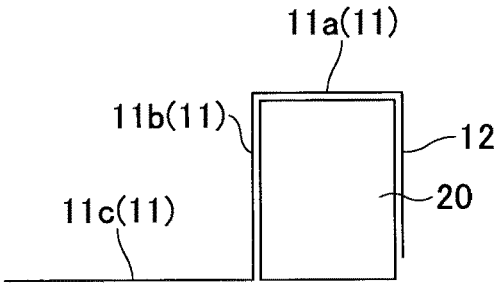
FIG. 4C is a bottom view illustrating an example of the antenna element including the conductive element provided at the base member.

FIG. 4A is a front view schematically illustrating an example of the first antenna element 10 including a conductive element provided at the base member 20. FIG. 4B is a right side view schematically illustrating an example of the first antenna element 10 including the conductive element provided at the base member 20. FIG. 4C is a bottom view schematically illustrating an example of the first antenna element 10 including the conductive element provided at the base member 20.

Figure 4D:
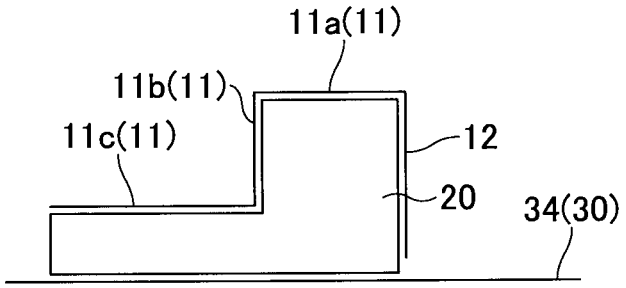
FIG. 4D is a bottom view illustrating another example of the antenna element including the conductive element provided at the base member.

FIG. 4D is a bottom view schematically illustrating another example of the first antenna element 10 including the conductive element provided at the base member 20. The shape of the base member 20 is not limited to the above described rectangular solid shape, and may have an L-shape cross section as illustrated in FIG. 4D, for example.

Figure 4E:
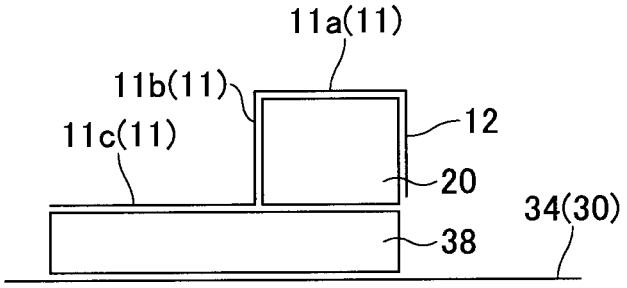
FIG. 4E is a view illustrating an example of a base member that is indirectly provided at the windshield.

FIG. 4E is a view illustrating an example of the base member 20 that is indirectly provided at the windshield 30. As illustrated in FIG. 4E, the base member 20 is indirectly provided at the glass surface 34 via an intermediate member 38. In other words, the intermediate member 38 is provided at the glass surface 34 in a physically contacted status, and the base member 20 is provided at the intermediate member 38 in a physically contacted status.

Figure 5:
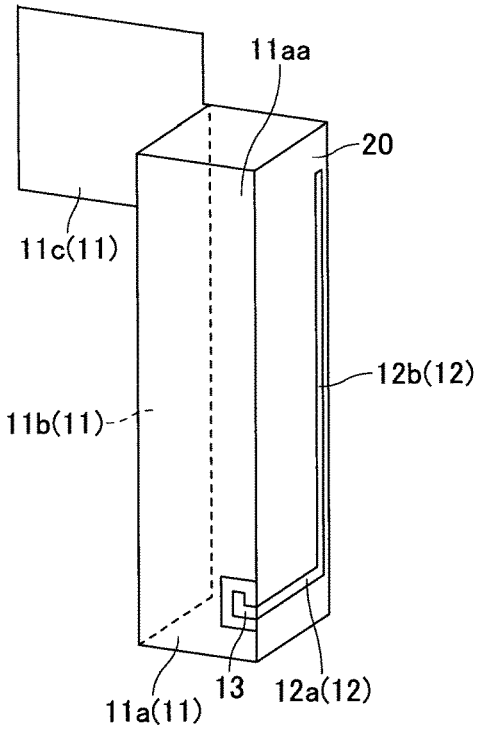
FIG. 5 is a perspective view illustrating an example of the antenna element.

FIG. 5 is a perspective view schematically illustrating an example of the first antenna element 10 including the conductive element provided at the base member 20. FIG. 5 illustrates an example of the first antenna element 10 whose trihedral figure is illustrated in FIGS. 4A, 4B and 4C. The following explanation regarding FIGS. 4A to 4E and FIG. 5 is also applied to the second antenna element 40. The first antenna element 10 includes the first conductive element 11 and the second conductive element 12.

The first conductive element 11 includes conductive portions 11*a*, 11*b* and 11*c* that are provided at the base member 20. For example, the tabular conductive portion 11*a* is provided at the front surface portion 21 (see FIG. 3) of the base member 20, the tabular conductive portion 11*b* is provided at the left side portion 22 (see FIG. 3) of the base member 20 and the tabular conductive portion 11*c* is provided at at least one of the attaching portion 26 of the base member 20 and the glass surface 34 which the attaching portion 26 contacts (see FIG. 3). Meanwhile, the second conductive element 12 includes conductive portions 12*a* and 12*b* that are provided at the base member 20, and is formed to have an L-shape by the conductive portions 12*a* and 12*b*. For example, the linear conductive portions 12*a* and 12*b* are provided at the right side portion 23 (see FIG. 3) of the base member 20.

As illustrated in FIGS. 4A to 4E and FIG. 5, at least a part of the first conductive element 11 may be a wide width conductor. The conductive portions 11*a*, 11*b* and 11*c* are an example of a wide width conductor. It is preferable that the wide width conductor, that is the at least part of the first conductive element 11, is provided at a surface that is next to the left side portion 22 or the right side portion 23. For example, the wide width conductor, that is the at least part of the first conductive element 11, may be the front surface portion 21 of the base member 20, the attaching portion 26 facing the front surface portion 21, the top portion 24 or the bottom portion 25. For example, the conductive portion 11*b* is provided at the left side portion 22, and the conductive portion 11*a* is provided at the front surface portion 21 that is next to the left side portion 22.

For example, when at least a part of the first conductive element 11 is a wide width conductor that is provided along a side of the right side portion 23 at which the second conductive element 12 is provided and the first conductive element 11 is a ground conductor, electricity can be provided to the first antenna element 10 by a more simple structure. However, the present embodiment is not limited to such a structure.

The first antenna element 10 has a structure in which at least a part of the first conductive element 11 is a wide width conductor, and at least a part of sides of the wide width conductor is provided along a side of the right side portion 23 at which the second conductive element 12 is provided, for example. For such a structure, the current is generated in the first antenna element 10 near the front end portion 11*aa* (front end portion of the wide width conductive portion along a side of the right side portion 23) of the conductive portion 11*a* of the first conductive element 11 and the current flows to the open end of the conductive portion 12*b* of the second conductive element 12.

The composition of current vectors generated in the first antenna element 10 is determined by the composition of current vectors of a first current vector of currents that flow through the first conductive element 11 and a second current vector of currents that flow through the second conductive element 12. For example, for the above described embodiment, the first current vector is determined by distribution of the currents that flow from the front end portion 11*aa* to the first feeding point 13 and a direction extending from the front end portion 11*aa* to the first feeding point 13. The second current vector is determined by composition of vectors of distribution of the currents that flow from the first feeding point 13 to a front end portion of the conductive portion 12*a*, a direction extending from the first feeding point 13 to the front end portion of the conductive portion 12*a*, distribution of the currents that flow from the front end portion of the conductive portion 12*a* to a front end portion of the conductive portion 12*b*, and a direction extending from the front end portion of the conductive portion 12*a* to the front end portion of the conductive portion 12*b*.

When providing the first antenna element 10 at the base member 20 and when the direction of the composition of current vectors generated in the first antenna element 10 is within an angle of 90°±45° with respect to the horizontal plane, transmitting and receiving characteristics of the radio waves of the vertical polarization that arrive from a direction parallel to the horizontal plane are improved. This means that the transmitting and receiving characteristics of the radio waves of the vertical polarization that arrive from the direction parallel to the horizontal plane is improved can be improved regardless of shifts of an attaching position or an attaching angle of the first antenna element 10, and positional robustness can be increased.

Here, the positional robustness is increased means that influence on the operation or the directivity of the first antenna element 10 is low even when arrangement positions of the first conductive element 11 and the second conductive element 12 are shifted. Further, as a degree of freedom for determining the arrangements of the first conductive element 11 and the second conductive element 12 is high, there is an advantage that the arrangement position and the attaching angle of the first antenna element 10 can be arbitrarily designed.

Figure 6:
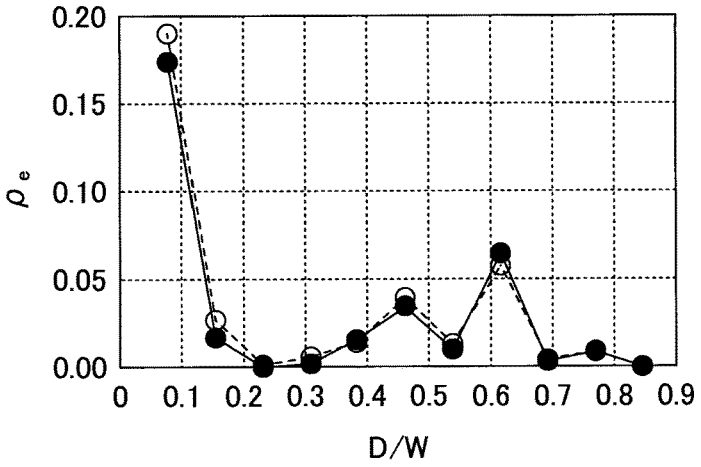
FIG. 6 is a graph illustrating an example of a relationship between D/W and a correlation coefficient.

FIG. 6 is a graph illustrating an example of a relationship between D/W and correlation coefficient $\rho_e$ regarding the first antenna element 10 and the second antenna element 40 each having the structures illustrated in FIGS. 4A to 4C and FIG. 5. In FIG. 6, filled circles indicate a case when the sun visors 61 and 62 do not overlap the upper edge portion 31, and open circles indicate a case when the sun visors 61 and 62 overlap the upper edge portion 31.

The measurement condition of FIG. 6 is a uniform distribution environment. This means that it is assumed that an expected value of the angular spread op in a horizontal surface is 3600°. For the arrival waves, by assuming that the number of the waves arriving from the horizontal direction is large, the mean arrival angle mt of the arrival waves of the angle distribution $P_\theta$ in the vertical plane is assumed as 90° (where a zenith direction is assumed as 0° and a nadir direction is assumed as 180°), and the angular spread of is assumed as 1°. It is assumed that the expected value of the angular spread op of the angle distribution $P_\varphi$ of the arrival wave in the horizontal surface is 3600° by assuming an environment in which sufficient multi-paths appropriate for a MIMO spatial multiplexing communication can be obtained.

The correlation coefficient $P_\theta$ of the axis of ordinates of FIG. 6 is obtained by changing the mean arrival angle σp for 36 patterns from 0° to 350° at 10° intervals, and calculating a mean value of correlation coefficients obtained for those mean arrival angles, respectively.

As illustrated in FIG. 6, even when D/W is less than or equal to 0.35, regardless of the existence of the sun visors 61 and 62, the correlation coefficient $\rho_e$ is less than or equal to 0.3. This means that the MIMO antenna 1 sufficiently functions as a MIMO antenna.

Figures 7, 8:
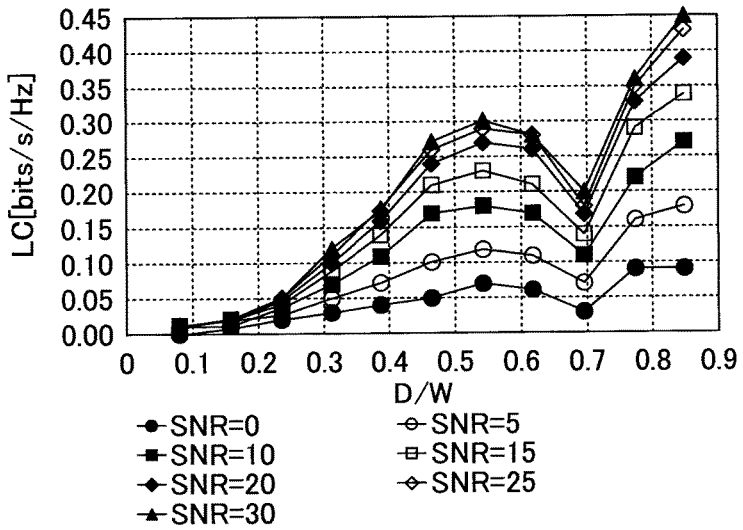
FIG. 7 is a table illustrating an example of D/W and a deterioration degree.
FIG. 8 is a graph illustrating an example of D/W and a deterioration degree.

FIG. 7 is a table illustrating an example of a relationship between D/W and deterioration degree LC of channel capacity C when changing SNR for the first antenna element 10 and the second antenna element 40 each having the structure as illustrated in FIGS. 4A to 4C and FIG. 5. FIG. 8 is a graph illustrating data of FIG. 7.

The SNR expresses a signal-noise ratio, and is a communication quality index defined by a ratio of a received signal electric power S and a noise electric power N (=S/N).

The deterioration degree LC indicates an index for evaluating deterioration of the channel capacity C. The deterioration degree LC is a value ($=C_0-C_1$) defined by a difference obtained by subtracting the channel capacity C ($=C_1$) when the sun visors 61 and 62 overlap the upper edge portion 31 from the channel capacity C ($=C_0$) when the sun visors 61 and 62 do not overlap the upper edge portion 31. This means that the lower the deterioration degree LC is the lower the deterioration of the channel capacity C is.

The measurement condition of FIG. 7 and FIG. 8 is a uniform distribution environment.

As illustrated in FIG. 7 and FIG. 8, even when the SNR varies, if D/W is less than or equal to 0.35, the deterioration degree LC can be suppressed to be less than or equal to 0.15. Thus, it is possible to suppress the deterioration of the channel capacity C due to the sun visors 61 and 62. As a unit of the deterioration degree LC is "bits/s/Hz", when the deterioration degree LC is 0.15, the amount of transmitted data becomes $2^{-0.15}=0.9$. This means that the amount of transmitted and received data when the sun visors 61 and 62 overlap the upper edge portion 31 corresponds to 90% of the amount of transmitted and received data when the sun visors 61 and 62 do not overlap the upper edge portion 31.

According to the embodiment, deterioration of channel capacity due to influence of a sun visor can be suppressed.

Although a preferred embodiment of the MIMO antenna and the MIMO antenna arrangement structure has been specifically illustrated and described, it is to be understood that minor modifications may be made therein without departing from the spirit and scope of the invention as defined by the claims.

The present invention is not limited to the specifically disclosed embodiments, and numerous variations and modifications may be made without departing from the spirit and scope of the present invention.

For example, the number of the antenna elements of the MIMO antenna is 3 or more. When the number of the antenna elements is 3 or more, it is assumed that the minimum distance D is a distance between conductive elements of a pair of antenna elements whose conductive elements each connected to respective feeding points are positioned closest.

The number of the sun visors may be one, or 3 or more.

What is claimed is:

1. A window glass with a MIMO antenna comprising:

a plurality of antenna elements respectively including a plurality of conductive elements that are connected to different feeding points from each other; and one or more base members each being directly or indirectly provided at an upper edge portion of a windshield of a vehicle, the conductive elements being provided at either of the base members, wherein the conductive element includes a conductive portion that is perpendicular with respect to a glass surface of the windshield, wherein D/W, where "W" is a width of an open portion of a window frame at which the windshield is provided and "D" is a minimum distance between the conductive elements of the antenna elements in a direction parallel to the direction of "W", is less than or equal to 0.35, wherein a correlation coefficient $\rho_e$ between the antenna elements at a resonance frequency is less than or equal to 0.3, and wherein the base members are provided at a center portion sandwiched between a right side region of the upper edge portion at which a sun visor overlaps and a left side region of the upper edge portion at which the sun visor overlaps in a vehicle width direction, when the windshield is attached to the vehicle.

2. The window glass with a MIMO antenna according to claim 1, wherein each of the conductive elements includes a conductive portion that is apart from a glass surface of the windshield.

3. The window glass with a MIMO antenna according to claim 2, wherein the conductive portions of the antenna elements are positioned at both sides of a vehicle width direction of the base member.

4. The window glass with a MIMO antenna according to claim 1, wherein the conductive elements of the antenna elements are line symmetrically positioned with respect to a center line extending in a vertical direction of the windshield.

5. The window glass with a MIMO antenna according to claim 1, wherein the one or more of the base members are directly or indirectly provided at a center portion of the upper edge portion.

6. The window glass with a MIMO antenna according to claim 1, wherein the conductive elements are provided at the same base member that is an attaching member for attaching a rear-view mirror at the upper edge portion.

7. The window glass with a MIMO antenna according to claim 1, further comprising:

a passive element that is not physically connected to either of the feeding points and is provided at the windshield.

8. The window glass with the MIMO antenna according to claim 1, wherein the base members are directly provided at the upper edge portion of the windshield of the vehicle, and wherein each of the conductive elements includes a conductive portion that contacts the windshield.

9. The window glass with a MIMO antenna according to claim 1, wherein the base members are directly provided at the upper edge portion of the windshield of the vehicle, and wherein each of the conductive elements includes a conductive portion that is provided to be parallel to the glass surface of the windshield.

10. The window glass with a MIMO antenna according to claim 1, wherein the conductive element includes a first conductive portion that is provided to be parallel to the glass surface of the windshield from the feeding point, and a second conductive portion that is provided to be perpendicular to the glass surface of the windshield from the feeding point.

11. A MIMO antenna arrangement structure comprising:

a windshield of a vehicle;

a pair of sun visors provided near an upper edge portion of the windshield;

a plurality of antenna elements respectively including a plurality of conductive elements that are connected to different feeding points from each other; and one or more base members each being directly or indirectly provided at an upper edge portion of a windshield of a vehicle, the conductive elements being provided at either of the base members, wherein the conductive element includes a conductive portion that is perpendicular with respect to a glass surface of the windshield, wherein D/W, where "W" is a width of an open portion of a window frame at which the windshield is provided and "D" is a minimum distance between the conductive elements of the antenna elements in a direction parallel to the direction of "W", is less than or equal to 0.35, wherein a correlation coefficient $\rho_e$ between the antenna elements at a resonance frequency is less than or equal to 0.3, and wherein the base members are provided at a center portion sandwiched between a right side region of the upper edge portion at which one of the sun visors overlaps and a left side region of the upper edge portion at which the other sun visor overlaps in a vehicle width direction, when the windshield is attached to the vehicle.

12. The MIMO antenna arrangement structure according to claim 11, wherein each of the conductive elements includes a conductive portion that is apart from a glass surface of the windshield.

13. The MIMO antenna arrangement structure according to claim 12, wherein the conductive portions of the antenna elements are positioned at both sides of a vehicle width direction of the base member.

14. The MIMO antenna arrangement structure according to claim 11, wherein the conductive elements of the antenna elements are line symmetrically positioned with respect to a center line extending in a vertical direction of the windshield.

15. The MIMO antenna arrangement structure according to claim 11, wherein the one or more of the base members are directly or indirectly provided at a center portion of the upper edge portion.

16. The MIMO antenna arrangement structure according to claim 11, wherein the conductive elements are provided at the same base member that is an attaching member for attaching a rear-view mirror at the upper edge portion.

17. The MIMO antenna arrangement structure according to claim 11, further comprising:

a passive element that is not physically connected to either of the feeding points and is provided at the windshield.

18. The MIMO antenna arrangement structure according to claim 11, wherein the base members are directly provided at the upper edge portion of the windshield of the vehicle, and wherein each of the conductive elements includes a conductive portion that contacts the windshield.

19. The MIMO antenna arrangement structure according to claim 11, wherein the base members are directly provided at the upper edge portion of the windshield of the vehicle, and wherein each of the conductive elements includes a conductive portion that is provided to be parallel to the glass surface of the windshield.

20. The MIMO antenna arrangement structure according to claim 11, wherein the conductive element includes a first conductive portion that is provided to be parallel to the glass surface of the windshield from the feeding point, and a second conductive portion that is provided to be perpendicular to the glass surface of the windshield from the feeding point.

* * * * *